US011313069B2

(12) United States Patent
Praveen et al.

(10) Patent No.: US 11,313,069 B2
(45) Date of Patent: Apr. 26, 2022

(54) STAIN REMOVAL ACCESSORY

(71) Applicant: KONINKLIJKE PHILIPS N.V., Eindhoven (NL)

(72) Inventors: Kannan Udayappan Praveen, Eindhoven (NL); Yile Liao, Eindhoven (NL); Shenghuai Calvin Lin, Eindhoven (NL); Chien-Ping Adrian Koh, Eindhoven (NL); Lihong Zhao, Eindhoven (NL); Yong Jiang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/093,191

(22) PCT Filed: Oct. 31, 2017

(86) PCT No.: PCT/EP2017/077902
§ 371 (c)(1),
(2) Date: Oct. 12, 2018

(87) PCT Pub. No.: WO2018/083092
PCT Pub. Date: May 11, 2018

(65) Prior Publication Data

US 2019/0249354 A1 Aug. 15, 2019

(30) Foreign Application Priority Data

Nov. 1, 2016 (EP) ..... 16196680
Aug. 7, 2017 (EP) ..... 17185094

(51) Int. Cl.
*D06F 43/00* (2006.01)
*A47L 25/08* (2006.01)
(Continued)

(52) U.S. Cl.
CPC ..... *D06F 43/002* (2013.01); *A47L 25/08* (2013.01); *C1D 11/0017* (2013.01);
(Continued)

(58) Field of Classification Search
CPC ..... D06F 43/002; D06F 7/04; D06F 87/00; A47L 25/08; A47L 25/00; A47L 13/17
(Continued)

(56) References Cited

U.S. PATENT DOCUMENTS 2,009,365 A * 7/1935 Walt ..... D06F 43/002 8/142
2,011,635 A * 8/1935 Homan ..... D06F 43/002 401/148
(Continued)

FOREIGN PATENT DOCUMENTS

CN 2464241 Y 12/2001
CN 1398235 A 2/2003
(Continued)

*Primary Examiner* — Michael E Barr
*Assistant Examiner* — Thomas Bucci
(74) *Attorney, Agent, or Firm* — Schott, P.C.

(57) ABSTRACT

A stain removal accessory that cooperates with a stain removal device for treating a stained area is attached to a front head of the stain removal device, namely to a water and/or steam venting face of the stain removal device. The stain removal accessory includes a container like a pad, a cartridge, a sachet, or a capsule provided with a permeable external layer, for containing a stain removing material, and a flap-flip piece including a holder for holding the container, whereby the stain removal accessory is adapted to release the stain removing material on the stained area when cooperating with the stain removal device by facing a flow of water and/or steam generated by the stain removal device.

15 Claims, 17 Drawing Sheets

(51) Int. Cl.
*C11D 11/00* (2006.01)
*C11D 17/04* (2006.01)
*D06F 87/00* (2006.01)
*D06F 105/28* (2020.01)

(52) U.S. Cl.
CPC ..... *C11D 17/041* (2013.01); *D06F 87/00* (2013.01); *D06F 2105/28* (2020.02)

(58) Field of Classification Search
USPC ..... 8/158, 137, 148, 142; 68/213, 5 A, 200, 68/205 R, 240, 214, 207, 235 R
See application file for complete search history.

(56) References Cited

U.S. PATENT DOCUMENTS 2,058,632 A * 10/1936 Riebel, Jr. ..... D06F 43/002 8/142
2,119,906 A * 6/1938 Dorman ..... B05B 15/30 239/343
2,164,965 A * 7/1939 Traube ..... D06F 43/002 68/214
2,185,575 A * 1/1940 Stinson ..... A47L 25/08 401/205
2,225,540 A * 12/1940 Tainton ..... A47L 25/08 401/200
2,254,691 A * 9/1941 MacLelland, Jr. .... D06F 43/002 68/5 A
2,258,115 A * 10/1941 Kingman ..... A47L 25/08 401/194
2,301,227 A * 11/1942 Pickett, Jr. ..... D06F 43/002 68/20
2,444,728 A * 7/1948 Castoe ..... D06F 43/002 68/5 B
2,552,853 A * 5/1951 Isserstedt ..... D06F 43/002 68/213
2,564,818 A * 8/1951 Schwartz ..... D06F 43/002 239/530
2,586,569 A * 2/1952 Sedgwick ..... D06F 43/002 68/18 R
2,790,984 A * 5/1957 Gilpin ..... A47L 25/08 401/125
2,896,236 A * 7/1959 Bartkewitz ..... A47L 23/05 401/202
2,942,791 A * 6/1960 Brock ..... D06B 1/02 239/434
2,975,448 A * 3/1961 Glaser ..... A47L 25/08 15/22.1
2,987,906 A * 6/1961 Bourland ..... D06F 43/002 68/213
3,000,202 A * 9/1961 Granados ..... D06F 43/002 68/222
3,046,593 A * 7/1962 Goldman ..... D06F 43/002 401/202
3,091,403 A * 5/1963 Schraber ..... D06F 43/002 239/416.1
3,196,478 A * 7/1965 Baymiller ..... A61K 8/11 401/132
3,261,515 A * 7/1966 Luedtke ..... B65D 47/42 222/520
3,500,666 A * 3/1970 Calcaterra ..... D06F 43/002 68/222
3,686,125 A * 8/1972 Miller ..... A47L 13/19 8/142
4,111,567 A * 9/1978 Berghahn ..... B65D 47/42 401/202
4,133,614 A * 1/1979 Baginski ..... B65D 47/42 401/206
4,279,057 A * 7/1981 Restivo ..... D06F 43/002 15/396
4,437,203 A * 3/1984 Wisner ..... A47L 11/38 15/322
4,659,496 A * 4/1987 Klemm ..... C11D 17/047 206/568
4,728,210 A * 3/1988 Barish ..... A45D 40/00 401/6
4,758,217 A * 7/1988 Gueret ..... A61F 7/10 604/500
4,775,256 A * 10/1988 Roth ..... A47K 7/03 401/145
4,961,661 A * 10/1990 Sutton ..... A45D 34/04 401/140
5,122,158 A * 6/1992 Kuroda ..... B65D 47/42 15/104.93
5,322,382 A * 6/1994 Hull ..... A45D 34/04 401/131
5,402,657 A * 4/1995 Henry, Jr. ..... D06F 43/002 68/200
5,649,334 A 7/1997 Henriquez et al.
5,707,163 A * 1/1998 Gregory ..... A46B 11/0013 401/10
5,765,407 A * 6/1998 Choo ..... A47L 25/08 15/104.94
5,785,193 A * 7/1998 Kobayashi ..... B65D 47/0814 16/227
5,840,675 A * 11/1998 Yeazell ..... A47L 25/08 510/417
5,846,011 A * 12/1998 Bernstein ..... A61M 35/006 401/205
5,872,090 A * 2/1999 You ..... A47L 25/08 510/284
5,891,197 A * 4/1999 Young ..... A47L 25/08 510/281
6,048,368 A * 4/2000 Tcheou ..... A47L 25/08 510/276
6,058,548 A * 5/2000 Footer ..... A47L 13/12 15/119.2
6,171,346 B1 * 1/2001 Yeazell ..... A47L 25/08 510/297
6,183,154 B1 * 2/2001 Coe ..... G01F 11/262 222/456
6,231,259 B1 * 5/2001 Murgida ..... A61K 8/28 401/175
6,233,771 B1 * 5/2001 Hortel ..... A46B 5/02 15/143.1
6,360,753 B1 * 3/2002 Vickers ..... A45D 34/04 132/320
6,422,778 B2 * 7/2002 Baumann ..... A61B 17/20 401/134
6,514,924 B1 2/2003 Van Hauwermeiren
6,523,550 B2 * 2/2003 McCormick ..... A45D 34/04 132/320
6,547,471 B1 * 4/2003 Tucker ..... B65D 47/2075 401/183
6,602,010 B1 8/2003 Doyle et al.
6,682,246 B2 * 1/2004 Reggiani ..... B65D 83/285 401/183
6,688,795 B1 * 2/2004 Jacob ..... A45D 34/04 401/202
6,829,913 B2 * 12/2004 Goldoni ..... A47L 25/08 510/277
6,872,021 B1 * 3/2005 Wilson ..... A47L 13/22 15/104.93
6,874,190 B2 * 4/2005 Deflander ..... A47L 25/08 8/158
6,883,353 B2 * 4/2005 Goldoni ..... A47L 25/08 510/277
7,047,582 B2 * 5/2006 Moe ..... C11D 1/83 68/235 R
D536,481 S * 2/2007 Angeletta ..... D28/7
7,389,658 B2 * 6/2008 Soberg ..... A47L 25/08 68/200
7,469,703 B2 * 12/2008 France ..... A46B 9/00 134/25.2
7,596,974 B2 * 10/2009 Smith ..... C11D 17/041 134/201
7,618,207 B2 * 11/2009 Thiebaut ..... A45D 34/04 401/202

(56) References Cited

U.S. PATENT DOCUMENTS 7,682,097 B2 * 3/2010 Knopow ..... A47L 13/26 401/136
7,798,154 B2 * 9/2010 De Laforcade .... B65D 21/0228 132/113
8,468,635 B2 * 6/2013 Nikitczuk ..... A46B 11/002 15/22.2
2002/0020715 A1 * 2/2002 Gueret ..... B05B 7/2462 222/153.11
2002/0077266 A1 * 6/2002 Gabriel ..... A47L 25/08 510/297
2003/0017958 A1 * 1/2003 Wise ..... C11D 17/047 510/439
2003/0104962 A1 * 6/2003 Verherbrugghen .. C11D 17/041 510/296
2003/0217570 A1 11/2003 Dacosta
2004/0005186 A1 * 1/2004 Ueda ..... B65D 41/26 401/194
2004/0144140 A1 * 7/2004 Lee ..... D06F 73/00 68/222
2004/0234711 A1 * 11/2004 Young ..... A47L 13/17 428/34.1
2005/0059571 A1 * 3/2005 Mahdessian ..... D06L 1/00 510/438
2005/0100391 A1 * 5/2005 Dobbs ..... A47L 13/26 401/188 R
2005/0166642 A1 * 8/2005 Soberg ..... A47L 25/08 68/5 A
2006/0000048 A1 * 1/2006 Rosenzweig ..... B08B 3/00 15/320
2006/0122088 A1 * 6/2006 Sadlowski ..... C11D 3/38663 510/295
2006/0218736 A1 * 10/2006 Oberstadt ..... A47L 13/18 15/104.94
2007/0051391 A1 * 3/2007 Wolff ..... B08B 1/00 134/42
2007/0071535 A1 * 3/2007 Young ..... A47L 13/12 401/138
2007/0116507 A1 * 5/2007 Fagelman ..... A47L 25/08 401/137
2007/0147942 A1 * 6/2007 Sojka ..... B65D 65/46 401/7
2007/0289071 A1 * 12/2007 Smith ..... C11D 17/041 8/147
2008/0156350 A1 * 7/2008 Barlow ..... A47L 25/08 134/4
2008/0222817 A1 * 9/2008 Myhra ..... A47L 25/08 8/137
2008/0223419 A1 * 9/2008 Chun ..... D06F 43/002 134/104.2
2008/0317543 A1 * 12/2008 Jackson ..... A46B 11/0013 401/273
2010/0077557 A1 * 4/2010 deVirag ..... C11D 17/049 15/104.93
2010/0155431 A1 * 6/2010 Bartolucci ..... B05C 17/015 401/171
2010/0180388 A1 7/2010 Schirmer
2010/0186268 A1 7/2010 Sunder
2011/0167568 A1 * 7/2011 Littig ..... B65D 75/585 8/137
2011/0311296 A1 * 12/2011 Chawla ..... A46B 11/0006 401/137
2012/0000809 A1 * 1/2012 Bischoff ..... A47L 25/08 206/524.1
2012/0000814 A1 * 1/2012 Smith ..... A47L 25/08 206/576
2012/0145189 A1 * 6/2012 Knopow ..... F24V 30/00 134/6
2013/0047358 A1 * 2/2013 Shafer ..... A46B 11/0017 15/114
2013/0219758 A1 * 8/2013 Jiang ..... D06F 73/00 38/144
2013/0273277 A1 10/2013 Lee
2013/0312212 A1 * 11/2013 Kowalski ..... A47L 11/4086 15/322
2013/0333724 A1 * 12/2013 Moskowitz ..... A47L 13/16 134/6
2014/0030003 A1 * 1/2014 Stephenson, Jr. ..... B32B 27/34 401/132
2014/0157527 A1 * 6/2014 Corradini ..... B08B 1/001 8/137
2014/0352366 A1 * 12/2014 Seo ..... D06F 39/088 68/17 R
2015/0320294 A1 * 11/2015 Feldman ..... A47L 25/08 510/283
2016/0362828 A1 * 12/2016 Edwards ..... D06F 39/024
2017/0215572 A1 * 8/2017 Lenkiewicz ..... A46B 11/0062
2017/0245733 A1 * 8/2017 Mahdessian ..... A47L 25/08
2018/0142391 A1 * 5/2018 Hombroek ..... D06F 29/00

FOREIGN PATENT DOCUMENTS

CN 2607849 Y 3/2004
CN 101449951 A 6/2009
CN 103462565 A 12/2013
CN 104981565 A 10/2015
DE 102006025952 A1 12/2007
EP 0395151 A1 10/1990
EP 2708175 A2 3/2014
GB 236774 A 7/1925
JP S48-047984 U 6/1973
JP S49-022293 U 2/1974
JP S57-112790 U 7/1982
JP S58-117291 U 8/1983
JP S61-096885 U 6/1986
JP S63-039653 A 2/1988
JP H11-323723 A 11/1999
JP 2001-507271 A 6/2001
JP 2001-279573 A 10/2001
JP 2002-263042 A 9/2002
JP 2012-071867 A 4/2012
JP 2016165527 A 9/2016
KR 1020060061223 A 6/2006
WO 2016037446 A1 3/2016

* cited by examiner $$Na_2CO_3 \cdot 1.5H_2O_2 \xrightarrow[\text{water}]{} Na_2CO_3 + 1.5H_2O_2$$
FIG.3
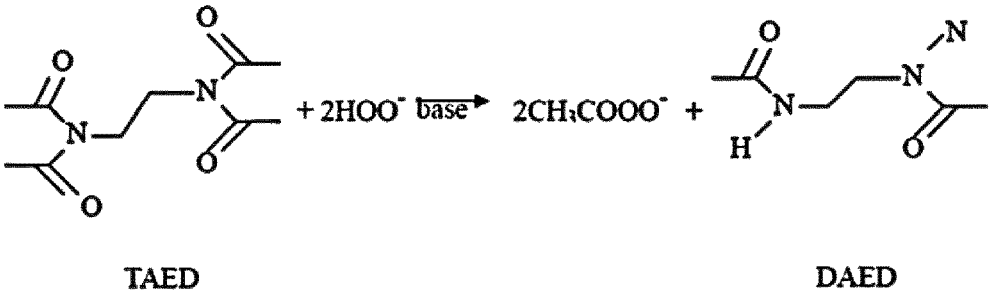
FIG.4
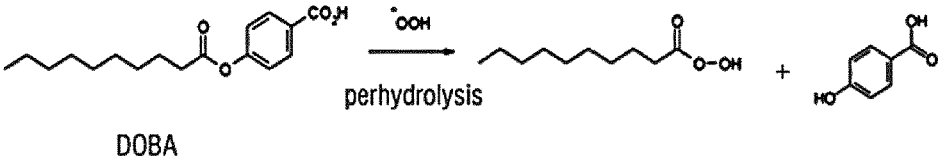
FIG.5

STAIN REMOVAL ACCESSORY

This application is the U.S. National Phase application under 35 U.S.C. § 371 of International Application No. PCT/EP2017/077902, filed on Oct. 31, 2017, which claims the benefit of European Application No. 16196680.9 filed on Nov. 1, 2016 and European Application No. 17185094.4 filed on Aug. 7, 2017. These applications are hereby incorporated by reference herein.

FIELD OF THE INVENTION

The present invention relates to the field of stain removal.

BACKGROUND OF THE INVENTION

Treating stain on garments via chemical is known, such as using a portable stick accessory containing a tank filled-in with chemical to be spread on the garment by user.

Those known solutions often imply the need to fill-in a container with liquid bleach chemical, which is not convenient for user, and involves some risks.

SUMMARY OF THE INVENTION

It is an object of the invention to propose a stain removal accessory that avoids or mitigates above-mentioned problems.

The invention is defined by the independent claims. The dependent claims define advantageous embodiments.

To this end, the stain removal accessory according to the invention comprises:

a container for containing a stain removing material, a holder for holding the container, The stain removal accessory is adapted to release said stain removing material on the stained area when cooperating with the stain removal device.

This solution allows a convenient and efficient stain removal, because the bleach chemical is already included in the stain removal accessory. In other words, the user only need to manipulate the stain removal accessory, which is convenient and safe.

The invention also relates to a stain removal device comprising means to cooperate with a stain removal accessory as described above.

The invention also relates a method of treating a stain on a garment by a stain removal device as mentioned above, using a stain removal accessory as mentioned above.

Detailed explanations and other aspects of the invention will be given below.

BRIEF DESCRIPTION OF THE DRAWINGS

These and other aspects of the invention will be apparent from and elucidated with reference to the embodiment(s) described hereinafter. In the following drawings FIG. 3 shows the chemical formation of $H_2O_2$ from sodium percarbonate, FIG. 4 shows the chemical formation of peroxy acid from TAED, FIG. 5 shows the chemical formation of peroxy acid from DOBA.

DETAILED DESCRIPTION OF THE EMBODIMENTS

The stain removal accessory according to the invention is intended to cooperate with a stain removal device for treating a stained area. The stain removal device is adapted to treat stain spots on garments locally without the need of washing the whole garment. The stain removal device may have any combination of integrated functions of the following steps:

1) stain removing by using water and/or steam applied to a stain removal material contained into the stain removal accessory,
2) rinsing off the stain residues and chemical residues,
3) evaporating water from the treated area of the garment.

Figure 1A:
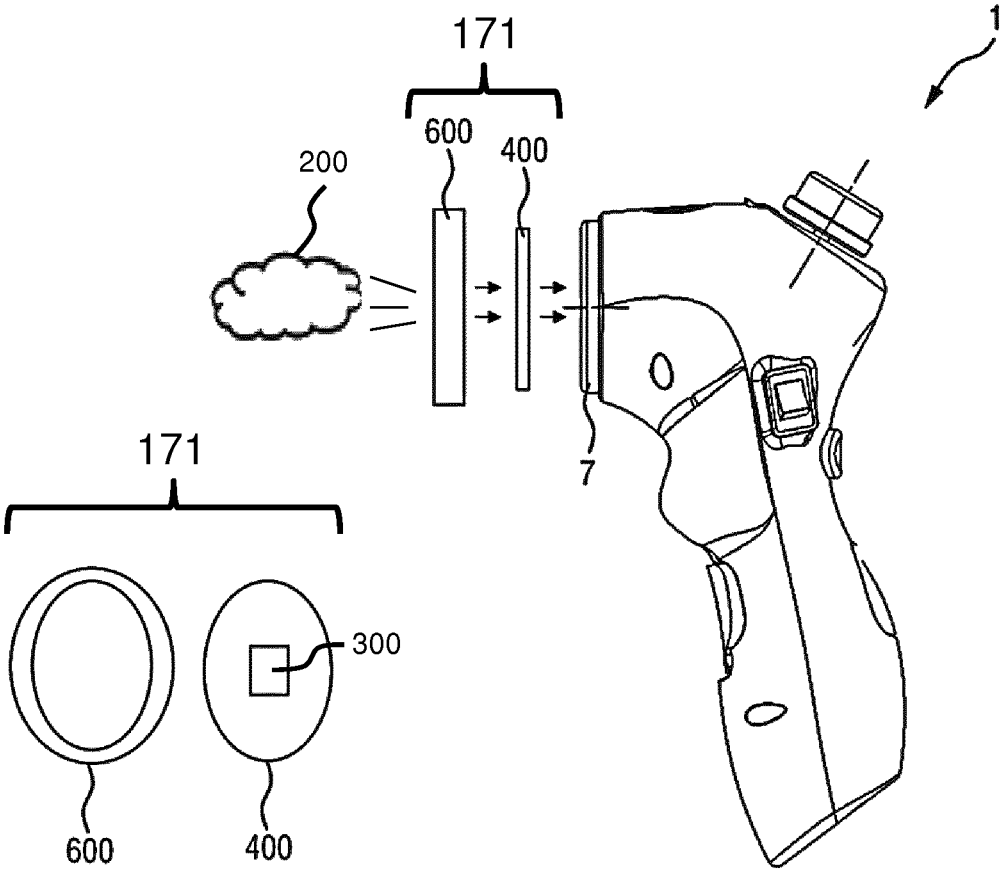
FIG. 1A is a schematic side view of the stain removal device 1 cooperating with a stain removal accessory 171 according to the invention.

FIG. 1A is a schematic side view of the stain removal device 1 cooperating with a stain removal accessory 171 according to the invention.

In the present context, it is noted that the stain removal accessory according to the invention can also be called a "chemical bleach applicator".

The stain removal accessory 171 comprises:

a container 400 for containing a stain removing material 300.

a holder 600 for holding the container 400.

It is noted that the holder 600 can also be called a "frame".

The stain removal accessory 171 is adapted to release the stain removing material 300 on the stained area when cooperating with the stain removal device.

Preferably, the container 400 is disposable.

The stain removing material 300 corresponds to bleach chemical. Most of stain removing material 300 (Sodium percarbonate, TAED, DOBA, NOBS, etc) used in a laundry cleaning or dish washer products are in solid form (e.g. powder, granule). The stain removing material 300 requires to be dissolved in fluid 200 generated by device 1 in order to release $H_2O_2$ or peroxy acid. In particular, fluid 200 corresponds to water and/or steam. $H_2O_2$ or peroxy acid kills bacteria and removes stains on a material like fabric, glass, or plastic by oxidizing the stain molecules from colored structure to colorless structure.

FIG. 3 shows the chemical formation of $H_2O_2$ from sodium percarbonate.

FIG. 4 shows the chemical formation of peroxy acid from TAED.

FIG. 5 shows the chemical formation of peroxy acid from DOBA.

The stain removing material 300 may contain:

Active oxygen sources, e.g. hydrogen peroxides ($H_2O_2$); Sodium percarbonate ($Na_2CO_3 \cdot 1.5H_2O_2$); sodium perborate ($NaBO_3 \cdot H_2O$, or $NaBO_3 \cdot 4H_2O$), etc. and Preferably also any one of the following bleach activator (taken alone or in combination):

- tetraacetylethylenediamine (TAED),
- 4-decanoyloxybenzoic acid (DOBA),
- sodium salt of nonanoyloxybenzenesulphonic acid (NOBS),
- sodium salt of 3,5,5-trimethylhexanoyloxyphenylsulfonic acid (iso-NOBS),
- sodium salt of acetoxyphenylsulfonate,
- sodium decanoyloxybenzene sulfonic acid (DOBS),
- sodium octanoyloxybenzene sulfonic acid (GOBS),
- GOBS,
- sodium nonanoyloxybenzoic acid (NOBA),
- N,N-Diacetylethylenediamine,
- N-[4-(triethylammoniomethyl) benzoyl]butyrolactam-chloride (TBBC), sodium trimethylhexanoyloxybenzenesulfonate (STHOBS),
- sodium-4-benzoyloxybenzenesulfonate (SBOBS),
- glucose pentaacetate (GPA),
- tetraacetylglucoluril (TAGU),
- nitrilotriacetate (NTA),
- transition metal bleach catalyst etc.

The stain removing material 300 is a chemical reagent in solid form (powder, granule), or in liquid form (in this case the liquid is held in a wet tissue, sponge . . . etc).

Preferably, the container 400 takes any of the forms defined by a bag, a pad, a cartridge, a sachet, and a capsule. The container 400 may looks like a "tea bag" with fluid-permeable external layer, for example made of density paper, fabric, non-woven fabric, porous plastic, etc.

The stain removal accessory 171 is adapted to release the stain removing material 300 on the stained area 101 when cooperating with the stain removal device 1.

Preferably, as illustrated, the holder 600 comprises a frame structure arranged at least partly around the container 400. For example, the frame structure can be circular, elliptic, arc-shaped, triangular, rectangular, square, semi-circular or semi-elliptic.

The right-side view of FIG. 1A shows an exploded view of the mounting of the stain removal accessory 171 when cooperating with device 1.

The stain removal accessory 171 can be mounted onto the steam venting face (sometimes combined with the heating plate together) of the device 1. Device 1 may correspond to a steam generation device, for example a garment steamer.

Figure 1B:
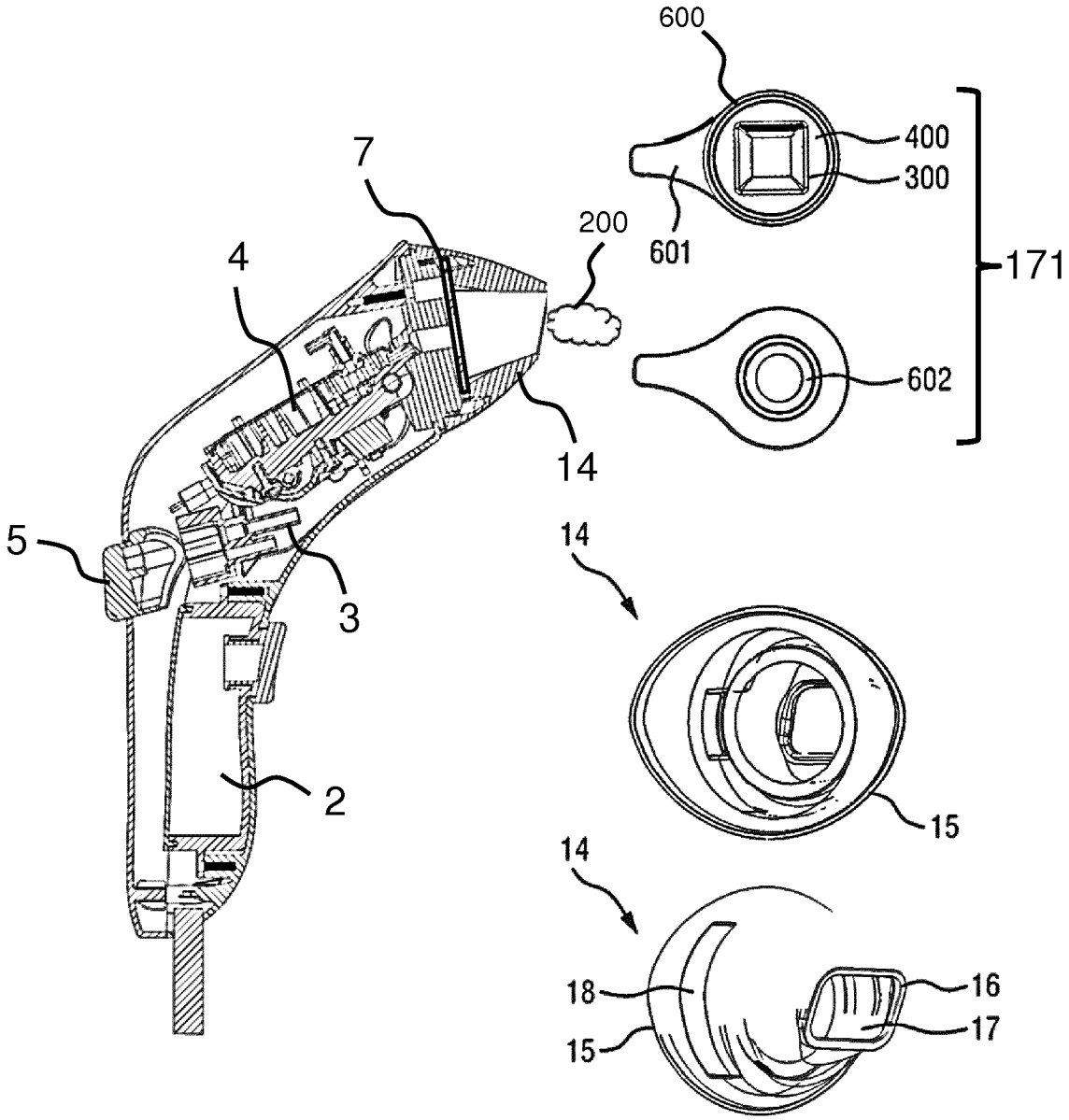
FIG. 1B shows internal schematic views of the stain removal device 1 and the stain removal accessory 171 according to the invention.

FIG. 1B are internal schematic views of the stain removal device 1 and the stain removal accessory 171 according to the invention.

Preferably, a guide head 14 is further assembled to the holder 600. Alternatively, the guide head 14 is assembled to the front side of the device 1, while the guide head 14 enclosing the stain removal accessory 171. The guide head 14 may comprise a back end interface 15 and a front end interface 16. The back end interface 15 receives the fluid 200 generated by the device 1. The front end interface 16 gathers the fluid 200 into a spout 17 facing the stained area on a fabric.

A liquid tank 2 supplies water to a dispensing mechanism 3, for example a pump. The dispensing mechanism 3 supplies water 200 to a steam engine 4. A pressing trigger 5 allows activating the dispensing mechanism 3. The steam engine 4 supplies steam 200 to the guide head 14. The heating plate 7 is in thermal connection the steam engine 4, so that the heating plate 7 can be heated.

In a first working mechanism, the fluid 200 generated by the device 1 is steam and passes through the container 400. The bleach solid 300 inside the container 400 is then dissolved by the steam condensation and carried out onto the stained area.

In a second working mechanism, the container 400 is used with (hot) water 200 generated by the stain remover device 1. To this end, water from the water tank 2 is carried by an additional pump (not shown) to the front head of the device 1. A heating element (not shown) is implemented if hot water is intended to be generated. The (hot) water/steam 200 passing through the container 400, and carries out the dissolved bleach solution 300 onto the stained area.

In a third working mechanism, if the stain removing material 300 is under liquid form in the container 400, there is no need for the device 1 to provide water and/or steam. The front head of the device 1 holding the stain removal accessory 171 is directly applied on the stained area.

Figure 2:
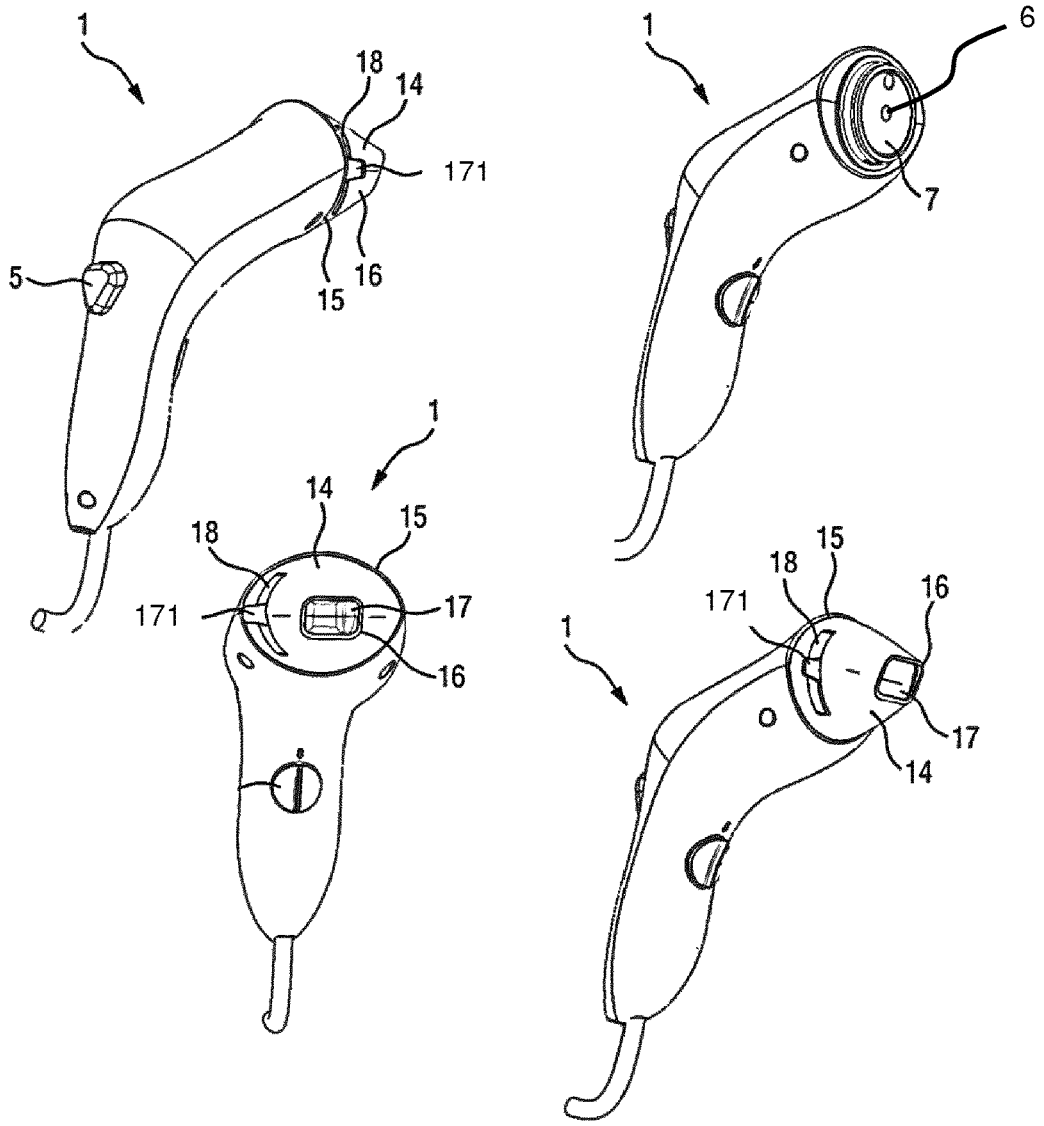
FIG. 2 shows various schematic perspective views of a stain removal device according to an embodiment of the present invention.

FIG. 2 shows various schematic perspective views of a stain removal device 1 using a guide head 14 for treating the stain on a fabric according to the present invention.

The opening 6 on the heating plate 7 is sized to enable the outgoing steam 200 to have a certain velocity. This velocity is a function of the size of the opening and the steam rate. For a steam rate of 25 g/min, the optimal opening dimension is 6 mm in diameter. This combination gives a good steam rate and velocity to enhance the rinsing because the velocity creates a pressure difference between the treatment side and underside of the fabric 100. The pressure difference pushes the fluid 200 through the fabric 100. The relatively low steam rate also enables longer operation without the need for a large liquid tank.

Optionally, the steam rate can be between 5 g/min and 150 g/min. The diameter of the opening 6 can be between 3 mm and 30 mm. The steam 200 can be pure dry steam 200 (commonly transparent and hard to be envisaged by naked eyes) or wet steam 200 (commonly white color). It was observed that wet steam 200 (steam with droplets of water) produced better rinsing results but wetter fabric 100.

Preferably, the holder 600 of the stain removal container comprises a hand grip 601 (also called a holding tab) allowing to easily inserting the holder 600 of the stain removal accessory 171 into the insert slot 18 of the stain removal device 1.

Furthermore, the holder 600 of the stain removal container 400 may comprise a rear 602 to create a thermal contact with the heating plate 7 when the holder 600 is attached to the device 1.

FIGS. 6A to 6F show a set of schematic usage illustrations of the stain removal device 1 with a stain removal accessory 171 according to the invention.

Figure 6A:
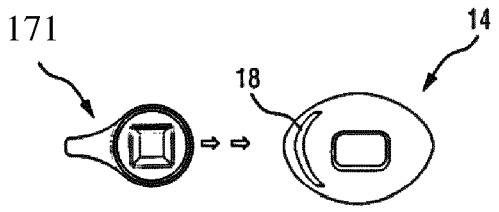
FIGS. 6A to 6F show a set of schematic usage illustrations of the stain removal device with a stain removal accessory according to the invention.
Figure 6B:
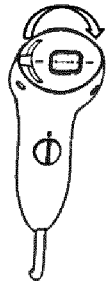

Device 1 comprises the guide head 14 attached to the steam venting face of the device 1, and with which the stain removal accessory 171 is intended to be cooperate, for example by inserting the stain removal accessory 171 in the slot 18 arranged in the guide head 14, as illustrated in FIG. 6A and FIG. 6B.

As most of bleach contents 300 (Sodium percarbonate, TAED, DOBA, NOBS, etc.) used in a laundry cleaning or dish washer product is in solid form (e.g. powder, granule), the bleach solid chemical contained in the container 400 requires to first be dissolved in water 200 in order to release $H_2O_2$ or peroxy acid. To this end, the stain removal accessory 171 is attached to the device 1 in order to release the dissolved bleach solution 300.

Figure 6C:
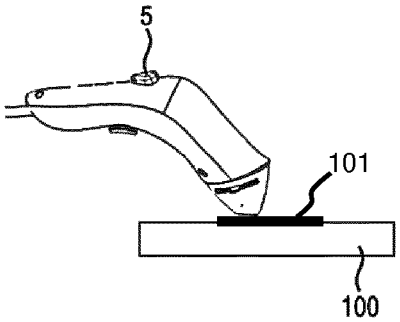

FIG. 6C shows the stain removing process.

The stain removing material 300 are cleaning agents that are pre-filled in the container 400. Once dissolved by water and/or steam, the stain removing material 300 are dispensed onto the stained area 101 of the fabric to react with, dissolve or cover the stain molecules. To this end, the front head of the device 1 can be brought into close contact with the stained area 101, as illustrated in FIG. 6C.

The device 1 may also provide heat to the stained area 101 in order to accelerate the chemical reaction, dissolving or covering rate. Heat sources include but are not limited to steam, conduction, infrared heat and microwaves. For example, a heating plate 7 can be used to generate heat by conduction.

In order to activate the stain treatment process, the rinsing pump is activated via the pressing trigger 5 (possibly repeatedly) so that water (and/or steam) can pass through the container 400.

Figure 6D:
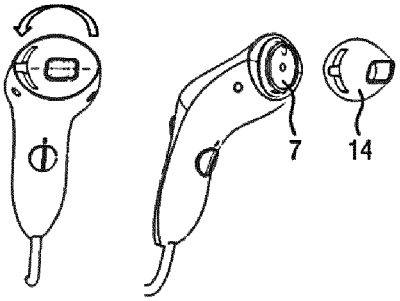
Figure 6E:
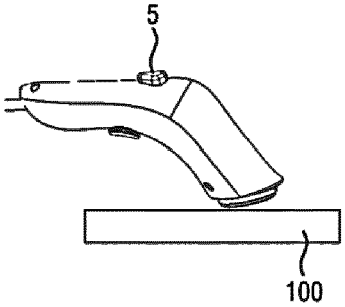

FIG. 6E shows the rinsing process. The main objectives of this stain rinsing process are:

1) to stop the chemical reaction upon after the step of stain removing, so as to prevent further chemical reactions.

2) to remove the stain removing material and their by-products from the garment 100 to avoid possible irritation/allergic reactions when the garment is put on by user.

It is noted that in order to guarantee that the fluid 200 used for rinsing (i.e. water, steam, chemical neutralizer or a combination of all) is not contaminated by the chemicals remaining in the container 400, the stain removal accessory 171 (or at least the container 400) needs to be removed from device 1 before starting the rinsing step.

FIG. 6D shows the detachment of the stain removal accessory 171 and guide head 14 from the device 1. The stain removal accessory 171 can for example be attached/detached via a rotating movement.

The rinse process can be achieved by either neutralization of the bleach chemical or dilution of the bleach chemical. For the best rinsing result, these chemical residues should preferably be extracted from the fabric by an absorption means (for example a backing pad, a tissue, a towel . . . ) or by mechanical forces. The rinsing process is activated by the pressing trigger 5 (possibly repeatedly).

Figure 6F:
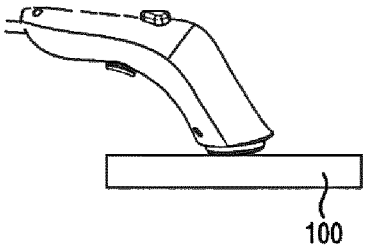

FIG. 6F shows the drying process.

Drying of the already rinsed fabric 100 relies on removal of the moisture on the fabric 100. The moisture can be evaporated through direct heating with the heating plate 7 (~100-170° C.) or heated air 7 (~60-100° C.).

In the following, solutions according to the invention will be disclosed with the goals of:

1. Saving the step of removing the stain removal accessory 171 (or the container 400 containing the stain removing material 300) before the step of rinsing.

2. Saving the space of placing the removed stain removal accessory 171 (or the container 400).

Figure 7:
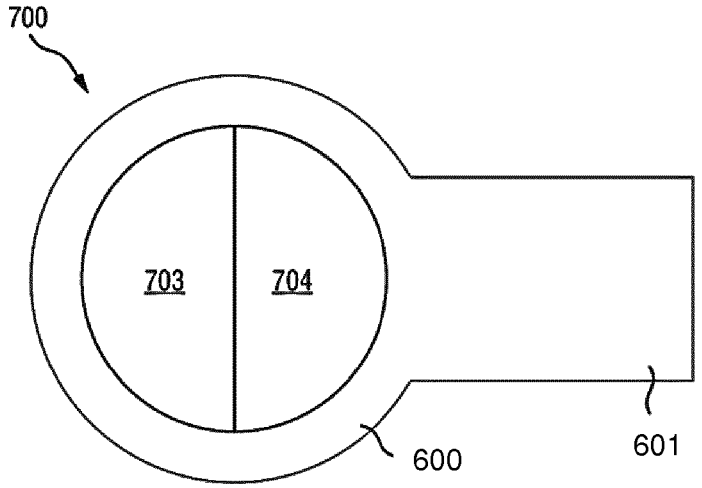
FIG. 7 and FIG. 8 depict another embodiment of a stain removal accessory according to the invention.
Figure 8:
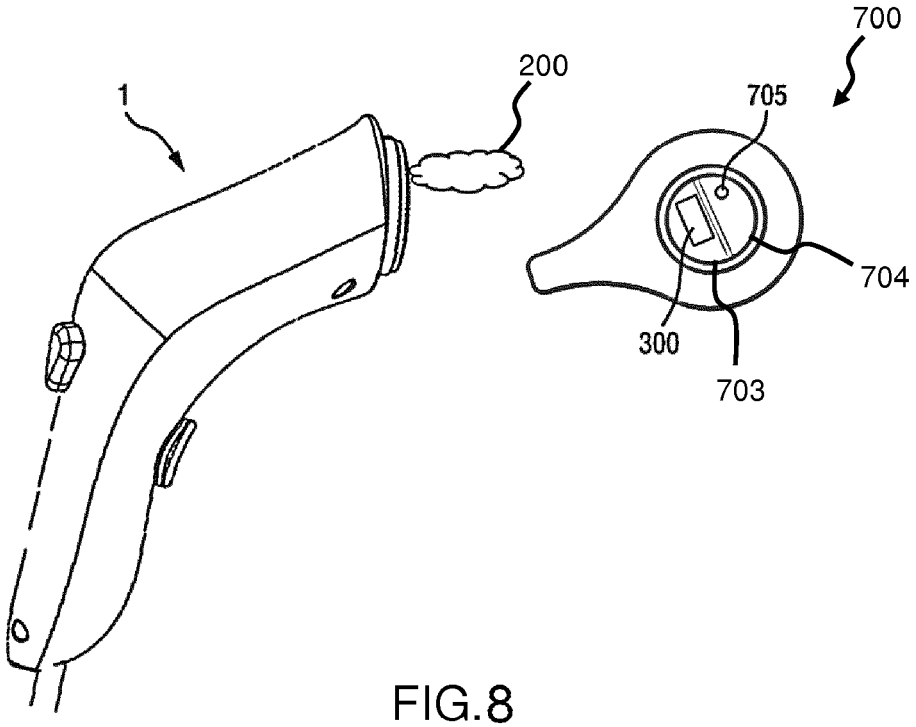

FIG. 7 and FIG. 8 depict another embodiment of a stain removal accessory 700 according to the invention.

Compared to the stain removal accessory 171 described above, the stain removal accessory 700 comprises at least two parts as follows:

- a first part 703 for arranging the container 400 containing the stain removing material 300,
- a second part 704 comprising a through hole 705.

The stain removal accessory is adapted to take a first position (P1) during a step of stain removing, and a second position (P2) during a step of rinsing the stained area.

The through hole 705 corresponds to an open fluid pathway.

For example, the through hole 705 is at an angular position different with respect to the angular position of the container. For example, the difference of the angular positions is 90 or 180 degrees.

The stain removal accessory 700 forms a pathway selector.

The working face of the stain removal accessory 700 is divided into at least two parts, the first part 703 is for storing the container 400 containing the stain removing material 300, the second part 704 is empty.

The stain removal accessory 700 also comprises a holder 600 with preferably a hand grip 601 for changing the position of the holder 600 compared to the device 1.

The holder 600 can be attached to the front head (having the steam venting face) of the stain remover device 1.

If container 400 containing the stain removing material 300 (i.e. cleaning reagent sachet/cartridge) is disposable, the container 400 is inserted into the first part 703 of the holder 600, while the second part 704 of the holder 600 is left empty. Alternatively, the second part 704 may contain a chemical neutralizer or fragrance agents (or vice versa) used during a step of rinsing the stained area.

The stain removal accessory 700 allows a selectable water pathway for stain treatment and rinsing when cooperating with a stain removal device.

Figure 9:
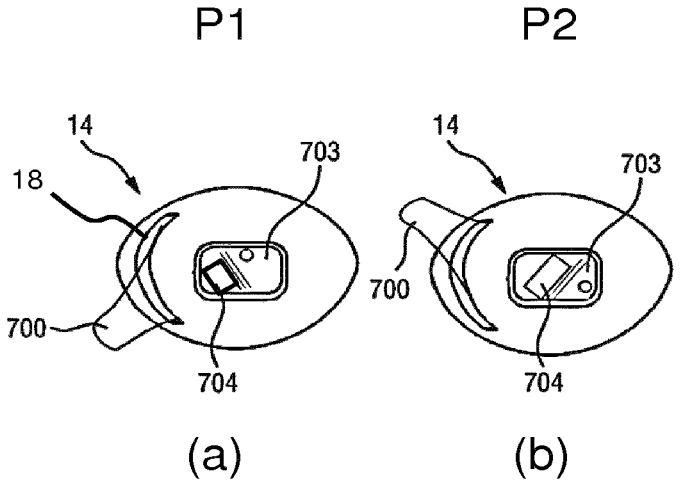
FIG. 9 depicts the stain removal accessory according to an embodiment of the present invention in two different positions.

When the stain removal accessory 700 cooperates with stain remover device 1, the following happens:

- Fluid such as water 200 passes through the container 400 during stain treatment process for dissolving the stain removing material 300 and carry the dissolved stain removing material 300 onto the stained area. In this step of stain removing, the stain removal accessory 700 is adapted to take a first position (P1) when cooperating with the stain removal device 1. This is illustrated by view (a) of FIG. 9.
- Fluid like water 200 passes the through hole 705 during rinsing process. In this step of stained area rinsing, the stain removal accessory 700 is adapted to take a second position (P2) when cooperating with the stain removal device 1. This is illustrated by view (b) of FIG. 9.

Preferably, the stain removal accessory 700 is rotatable when mounted to the stain removal device 1. For example, the stain removal accessory 700 is rotatable in the slot 18 arranged in the guide head 14. Rotating the stain removal accessory 700 provides a first position during a step of stain removing in which the first part 703 faces the flow of water and/or steam 200 generated by device 1, and a second position during a step of rinsing the stained area in which the second part 704 faces the flow of water and/or steam 200 generated by device 1.

Thus, the device 1 can provide two different functions by turning the holder 600 in a first direction or turning the holder 600 in an opposite direction, for example via the hand grip 601.

Instead of a relative rotation movement between the stain removal accessory 700 and the stain removal device 1, other executions to change the fluid pathway between a stain removing step and a rinsing step can be considered, such as flipping and un-flipping the holder 600 as described in the following.

Figure 10:
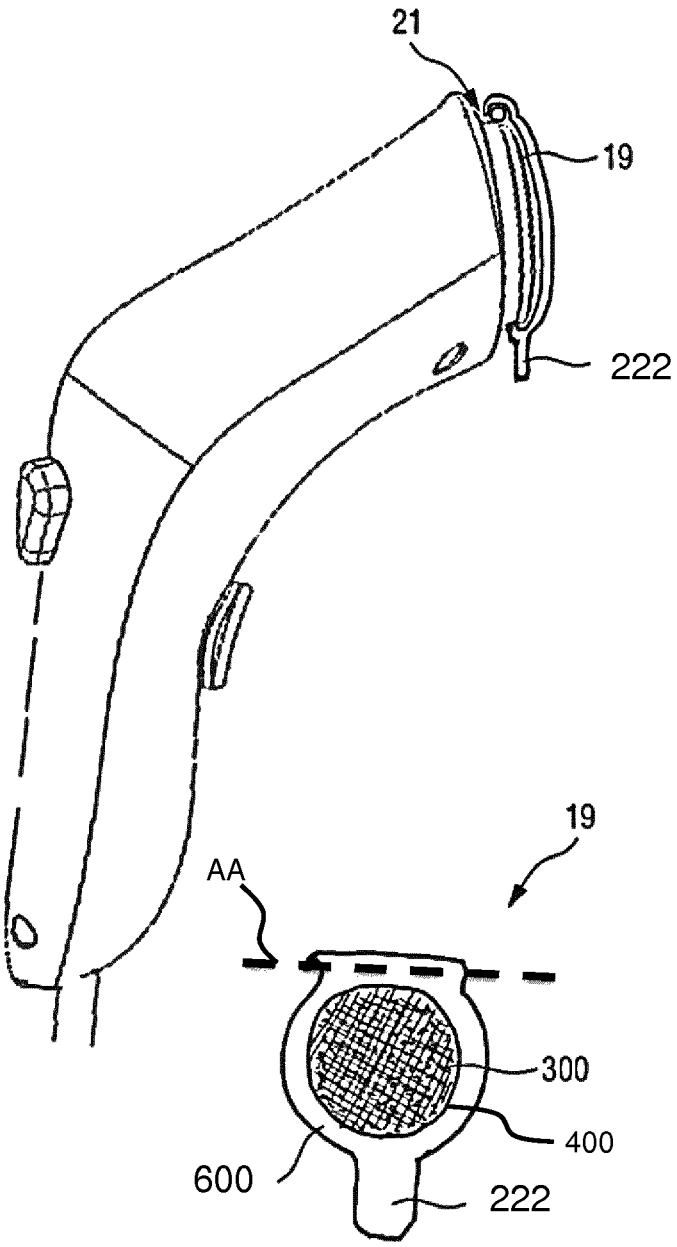
FIG. 10, FIG. 11 and FIG. 12 depict illustrations of an alternative embodiment of a stain removal accessory according to an embodiment of the present invention.
Figure 11:
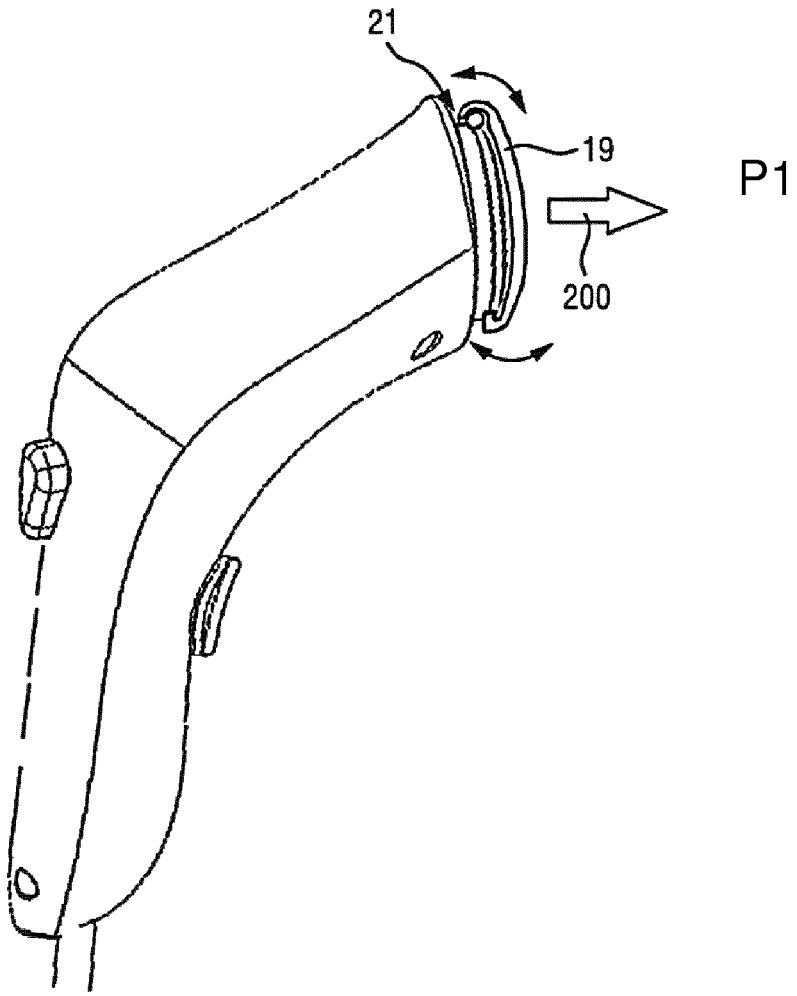

FIG. 10, FIG. 11 and FIG. 10 depict illustrations of an alternative embodiment of a stain removal accessory according to an embodiment of the present invention.

As illustrated in FIG. 10, the stain removal accessory defines a flap-flip piece 19 that can be mounted to the front head of device 1.

The flap-flip piece 19 is adapted to take a first position (P1) during a step of stain removing, and a second position (P2) during a step of rinsing.

The flap-flip piece 19 comprises a holder 600 which is attached to the steam-venting face of the stain removal device 1, for example by a hinge 21 rotating around an axis AA. The holder 600 is adapted to receive a container 400 containing a stain removing material 300 as described above, and is applied to produce the chemical reagent 300 with the help of the fluid (i.e. steam and/or water) 200 produced by the main body of the stain removal device 1 during the stain removing process.

The holder 600 may also comprise a hand grip 222 for easily changing the orientation of the holder 600 when the stain removal accessory 19 is mounted on the stain removal device 1.

FIG. 11 depicts the situation when the flap-flip piece 19 faces the front head of the stain removal device 1. In this position (P1), the water and/or steam generated by the device 1 passes through the container 400. This position corresponds to the step of stain removing.

Figure 12:
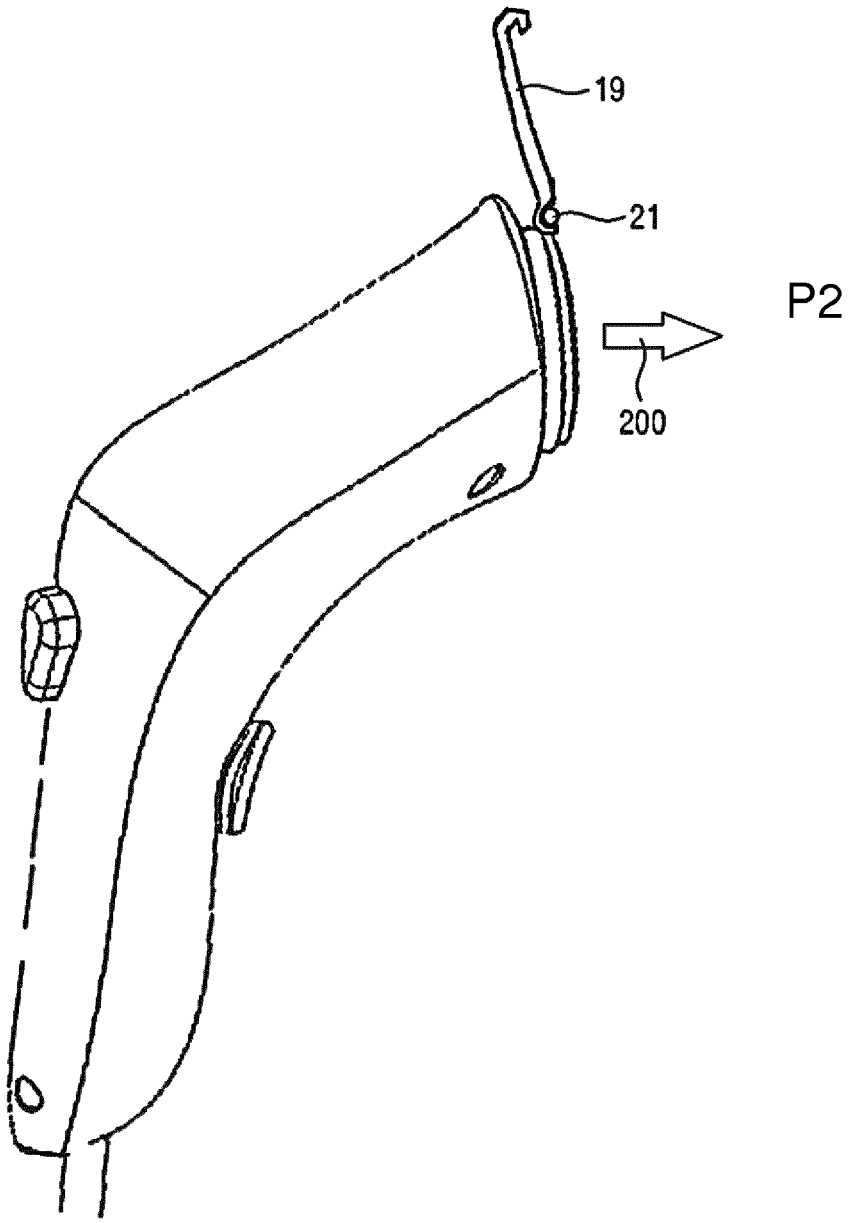

FIG. 12 depicts a situation when the flap-flip piece 19 does not face the front head of the device 1. In this position (P2), the water and/or steam generated by the device 1 does not pass through the container 400, and can be directly applied to the stained area. This position corresponds to the step of rinsing.

Figure 13:
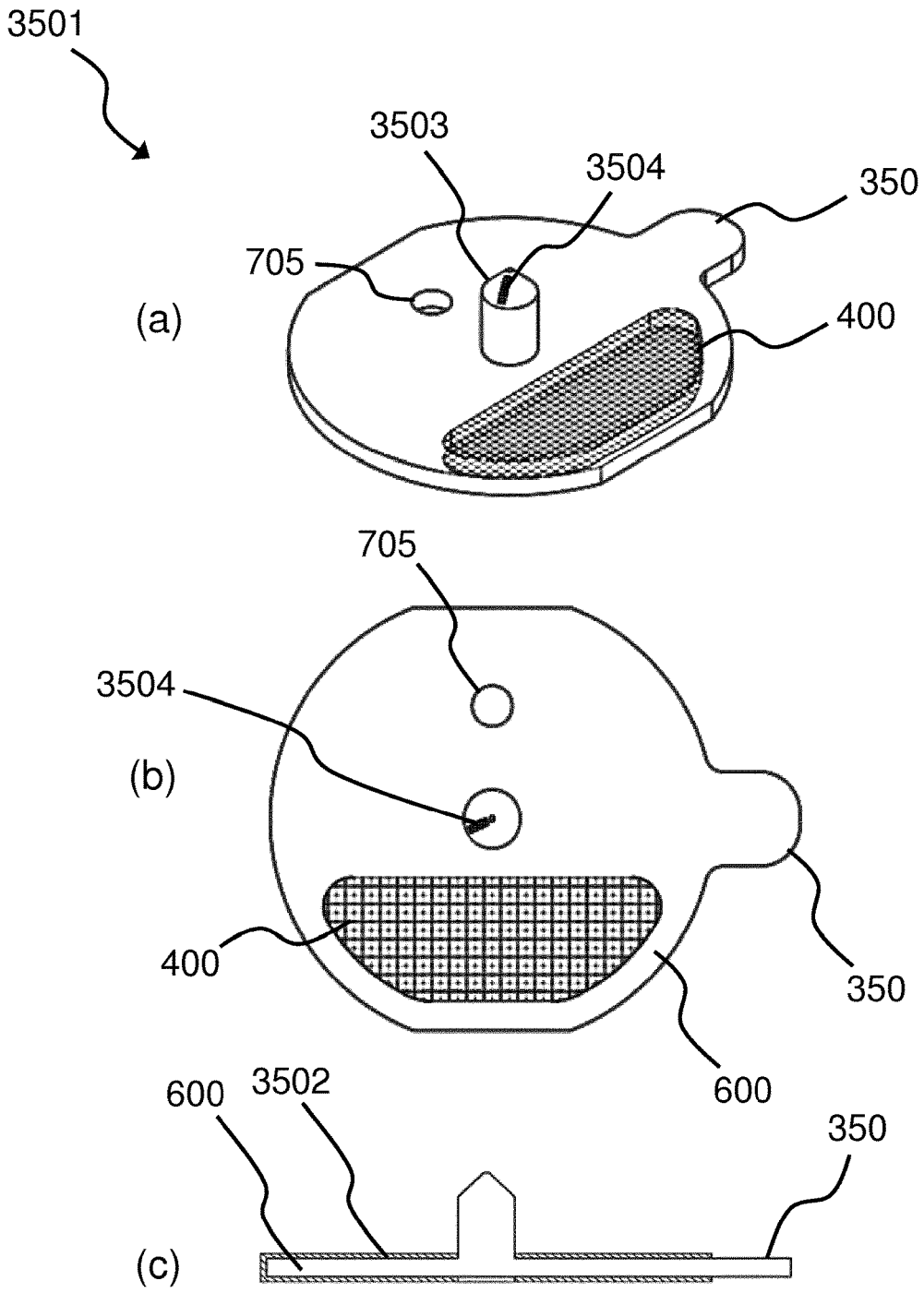
FIG. 13 depicts different views of another embodiment of a stain removal accessory according to the invention.

FIG. 13 depicts different views of another embodiment of a stain removal accessory 3501 according to the invention.

The view (a) corresponds to a three-dimensional view of the stain removal accessory 3501.

The view (b) corresponds to a top view of the stain removal accessory 3501.

The view (c) corresponds to a cross-section view of the stain removal accessory 3501.

The stain removal accessory 3501 is intended to cooperate with a stain removal device for treating a stain on a garment, such as a stain removal device 1 as described above.

The stain removal accessory comprises a holder 600 for holding a container 400 containing a stain removing material 300 as described above.

The container 400 is adapted to:

- receive water from the stain removal device for dissolving the chemical agent, and
- spreading the dissolved stain removing material over the stained area on the garment.

The stain removal accessory also comprises a through hole 705 for receiving water from the stain removal device during rinsing of the stain.

Preferably, the through hole 705 is at an angular position different with respect to the angular position of the container 400. For example, the difference of the angular positions is 90 or 180 degrees.

Preferably, the holder 600 is adapted to transfer heat from the stain removal device to the stained area.

For example, the holder 600 is made of a heat conductive/inductive material to allow the stain removal accessory to be heated up by the stain removal device and transfer heat to the stained area. For example, the heat conductive/inductive material takes the form of an outer layer 3502.

Figure 14:
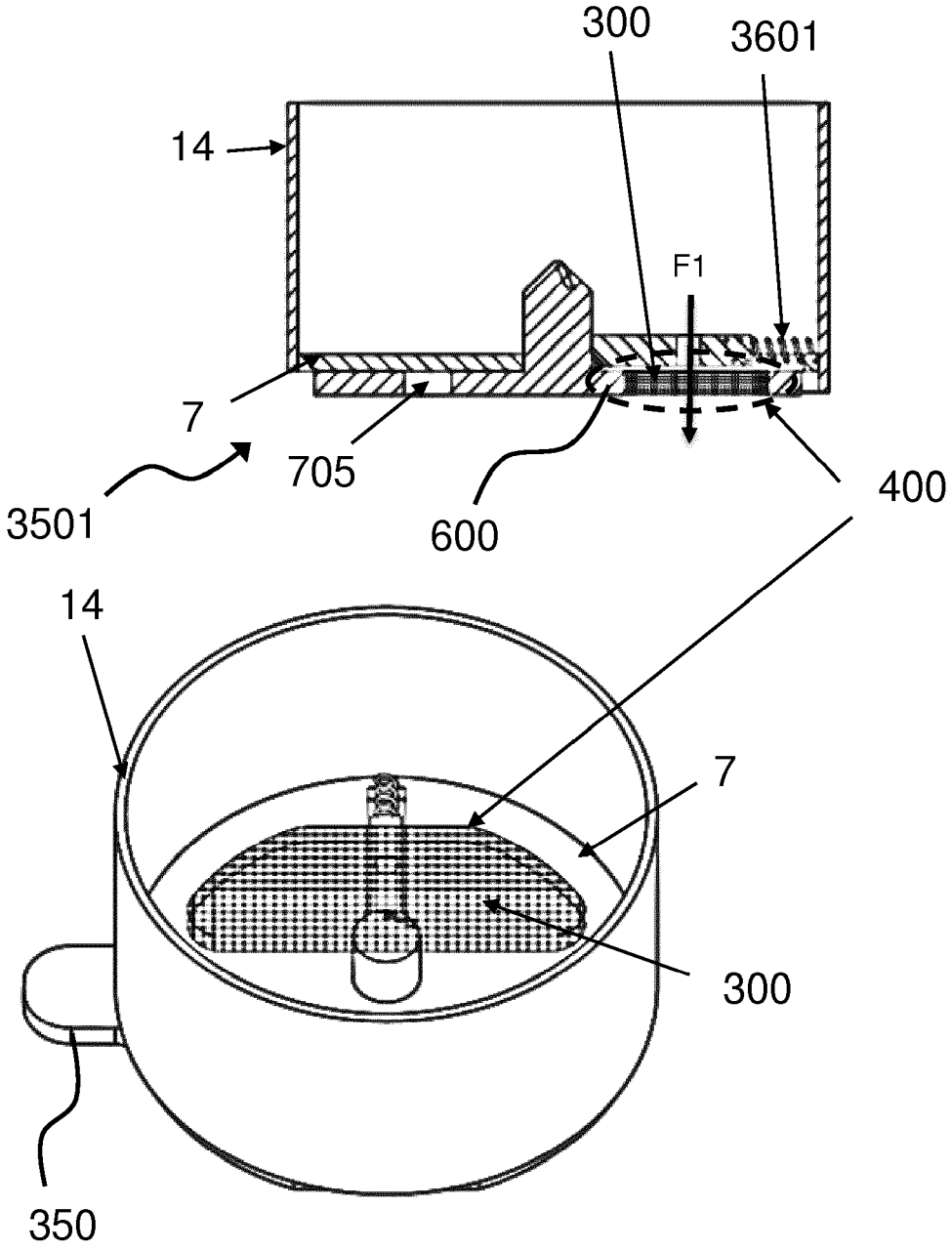
FIG. 14 depicts a stain removal accessory according to the invention when cooperating with the front head of a stain removal device, during the step of stain removing.

Preferably, the stain removal accessory further comprises a physical element 3503 to activate a water-flow switch 3601 in the stain removal device in order to open/close a water circuit. For example, the physical element 3503 may correspond to a protruding element. For example, the switch may correspond to a spring-loaded switch. The spring-loaded water-flow switch 3601 is illustrated in FIG. 14.

The water-flow switch is activated in either the steps of stain removing and rinsing, as those two steps require a flow of water.

Preferably, the stain removal accessory further comprises a capacitive and/or resistive element 3504 that can be detected by the stain removal device to turn-on the generation of heat on the stain removal device. For example, the generation of heat is performed by the heating plate arranged at the front head of the stain removal device.

Preferably, the stain removal accessory further comprises a hand grip 350, for example taking the form of an extended portion, used for inserting and rotating the stain removal accessory in the stain removal device.

The stain removal accessory 3501 can be disposable and designed for single use. In that case, the container 400 allows a one-time stain treatment.

Alternatively, only the container 400 is disposable. This means that the holder 600 which holds the container 400 can be re-used after another container 400 is placed in the holder 600.

Alternatively, the stain removal accessory 3501 is disposable and designed for a plurality of uses. To this end, the stain removal accessory 3501 contains a container 400 comprising a plurality of sub-compartments. Each sub-compartment holds a container containing stain removing material.

Figure 18:
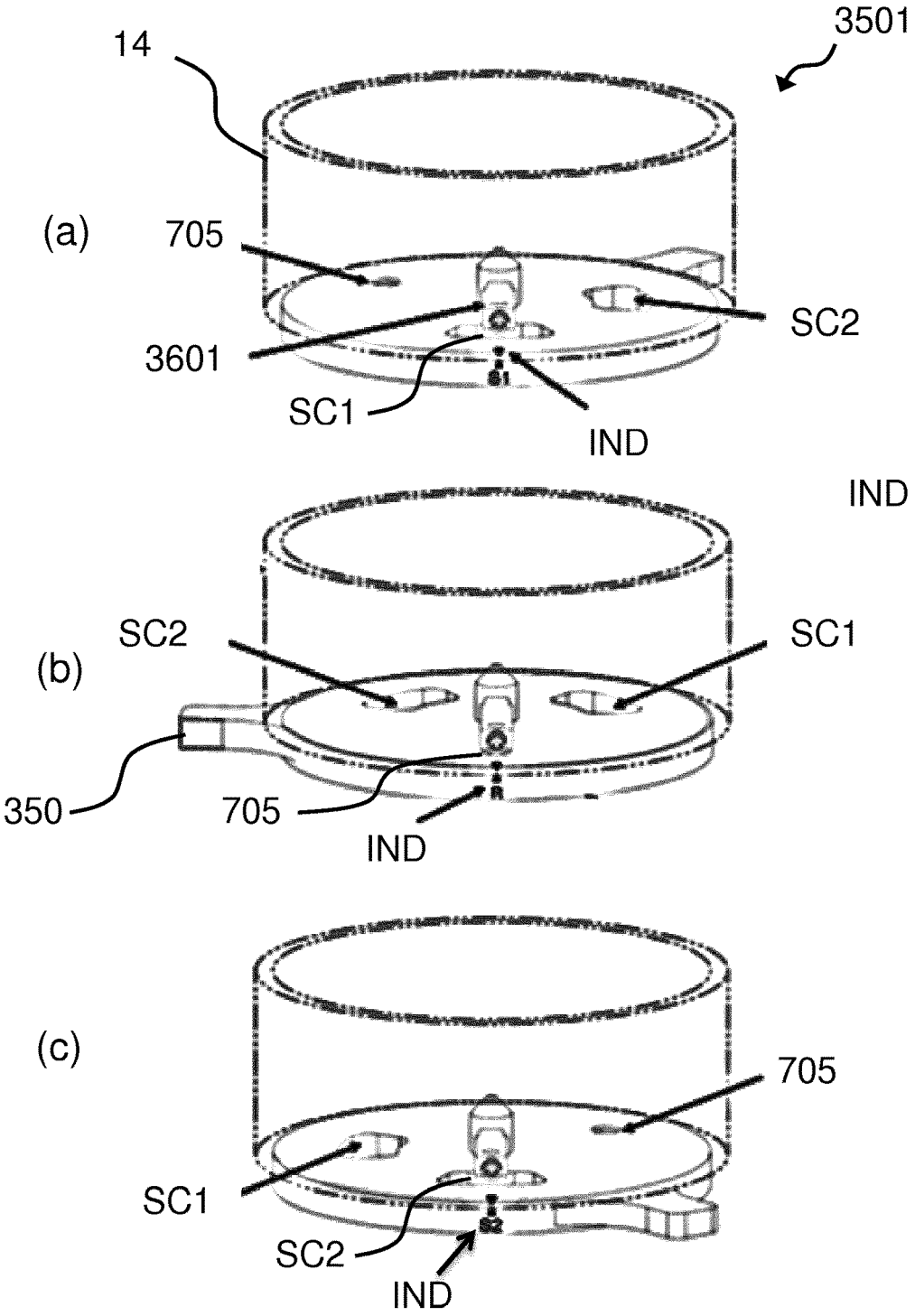
FIG. 18 depicts a stain removal accessory according to the invention implementing a container comprising a plurality of sub-compartments, each sub-compartment comprising a stain removing material.

FIG. 18 depicts a stain removal accessory 3501 according to the invention implementing a container comprising a plurality of sub-compartments, each sub-compartment comprising a stain removing material.

The stain removal accessory is represented when cooperating with the front head 14 of the stain removal device (not shown) as described above.

In this example, for sake of simplicity of describing this solution, only two sub-compartments are illustrated:

- a first sub-compartment SC1 to hold a first container containing stain removing material,
- a second sub-compartment SC2 to hold a second container containing stain removing material.

It is noted that a higher number of sub-compartments could be considered similarly.

In the view (a), the angular position of the stain removal accessory is such that the first container can receive water from the stain removal device in order to dissolve the stain removing material being inside, for a first stain treatment.

In the view (b), the angular position of the stain removal accessory is such that the through hole 705 for rinsing can receive water from the stain removal device in order to rinse the stained area previously treated by the first container. For example, an anticlockwise rotation has been operated compared to the view (a).

In the view (c), the angular position of the stain removal accessory is such that the second container can receive water from the stain removal device in order to dissolve the stain removing material being inside, for a second stain treatment. For example, an anticlockwise rotation has been operated compared to the view (b).

More generally, in case the stain removal accessory is dedicated for successively treating a plurality of stain, a plurality of container, each containing a stain removing material, are switched by moving (for example rotating) the stain removal accessory so that an unused container is positioned under the fluid flow outlet of the device.

To enable a proper alignment for each container with the fluid flow outlet of the device, as well as a proper alignment with the rinsing hole 705, indicators IND may be printed or engraved on both the device head and the stain removal accessory (such as "C1" which stands for "container 1", "C2" which stands for "container 2", "R" which stands for "rinsing").

In addition, the stain removal accessory may include locking studs that lock the stain removal accessory into proper position in the device when the respective pair of indicators on the stain removal accessory and device head are aligned.

Regardless of the number of sub-compartments in a given stain removal accessory (one or more containers), prior to the step of stain removing, in order to prevent the user from rotating the stain removal accessory to a container that has already been used, the bottom rim of each of the chemical sub-compartment may be coated with a paint that permanently changes color after contact with water or the chemical bleach.

FIG. 14 depicts a stain removal accessory according to the invention when cooperating with the front head 14 of a stain removal device, during the step of stain removing.

When the stain removal accessory is positioned in the stain removal device in the step of stain removing, three events occur concurrently:

- The capacitive and/or resistive element 3504 comes in contact with a sensor in the stain removal device, and the sensor activates the conductive/inductive heater in the device,
- The water-flow switch 3601 in the stain removal device is activated such that a hole of the water-flow switch 3601 is aligned with the container 400. Water from the device can thus flow through the container 400, dissolving the stain removal chemical in order to form a bleach chemical solution. Water-flow switch is activated (for example the spring is compressed and the hole of the water-flow switch 3601 is moved to an activated position) as long as the the stain removal accessory is attached to the stain removal device.
- The heat conductive/inductive material of the holder 600 is heated up by a heat generator comprised in the stain removal device. For example, the heat generator corresponds to the heating plate 7.

Therefore, when the stain removal accessory cooperates with the stain removal device in the step of stain removing, chemical solution from the stain removal accessory can be dosed onto the stained area. The chemical solution that has been dosed onto the stained area is heated by the heated holder 600, so that the heated chemical solution can more efficiently remove the stain. Indeed, the water dissolving rate of the bleach chemical increases while the temperature increases. So $H_2O_2$ or Peroxy acid will be released very fast while in contact with steam 200 or hot water 200.

In other words, heat is used to accelerate the chemical reaction between the chemical solution and the stain (and accelerate the drying after stain treatment). After the step of stain removing is completed, the heated holder 600 can be used to dry the stained area.

Figure 15:
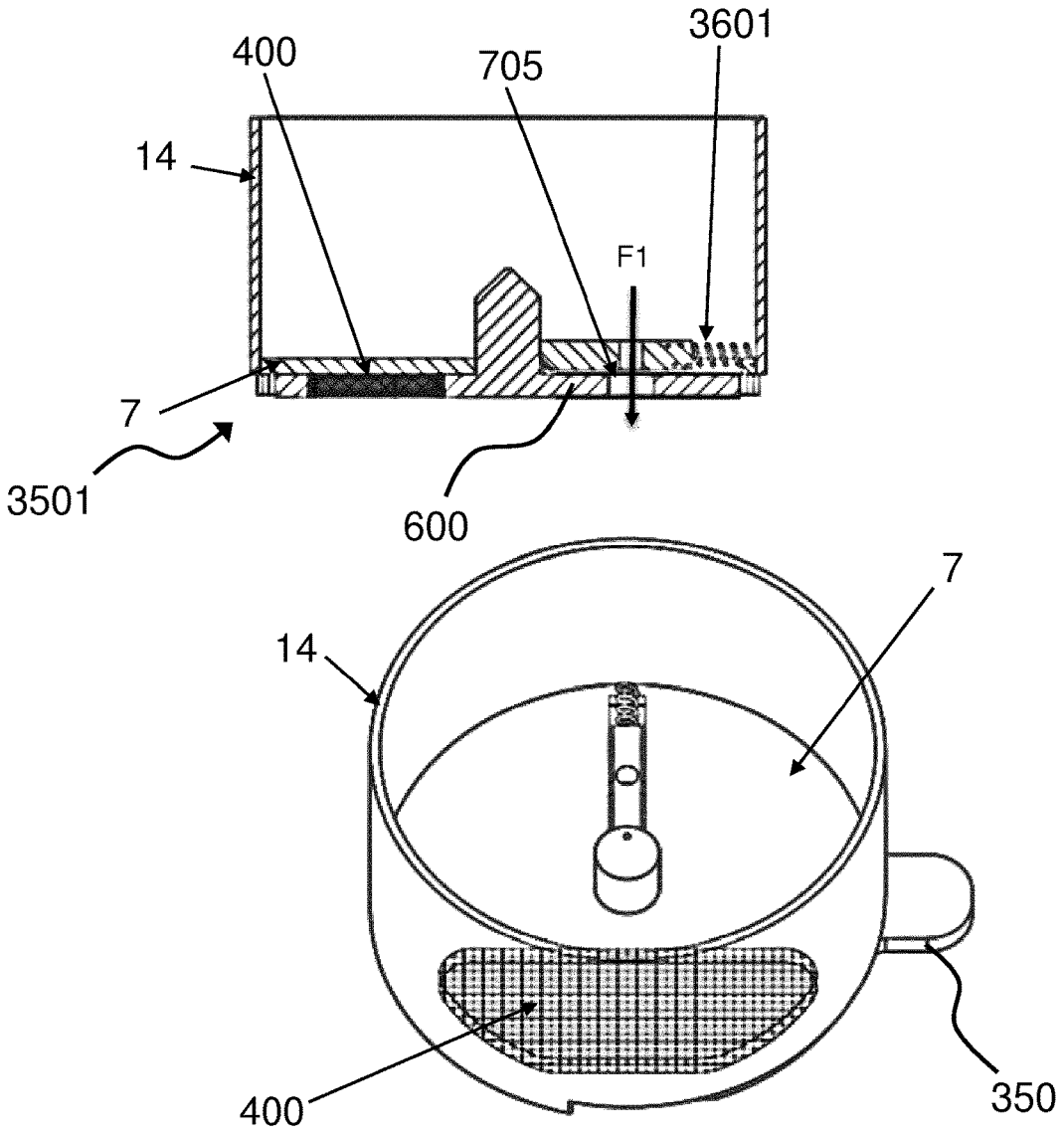
FIG. 15 depicts a stain removal accessory according to the invention when cooperating with the front head of a stain removal device during the step of rinsing the stained area.

FIG. 15 depicts a stain removal accessory according to the invention when cooperating with the front head 14 of a stain removal device during the step of rinsing the stained area.

When the stain removal accessory is positioned in the stain removal device in the step of rinsing, three events occur concurrently:

- The water-flow switch 3601 in the device continues to be activated such that the water-flow hole in the switch 3601 is aligned to the through hole 705 in the stain removal accessory, so that water from the stain removal device can flow through the hole 705 of the stain removal accessory. The water which is dosed can rinse the treatment stain residue out of the garment.
- The capacitive and/or resistive element 3504 continues to contact with the sensor in the stain removal device, and the sensor continues to activate the conductive/inductive heater in the stain removal device, which results in heating up the holder 600. The heat which is communicated to the stained area first improves the rinsing efficiency, and secondly, when the flow of rinsing water is stopped, the wet garment can be dried by the heated stain removal accessory. Rinsing duration is dependent on the required quality of rinse.

Figure 16:
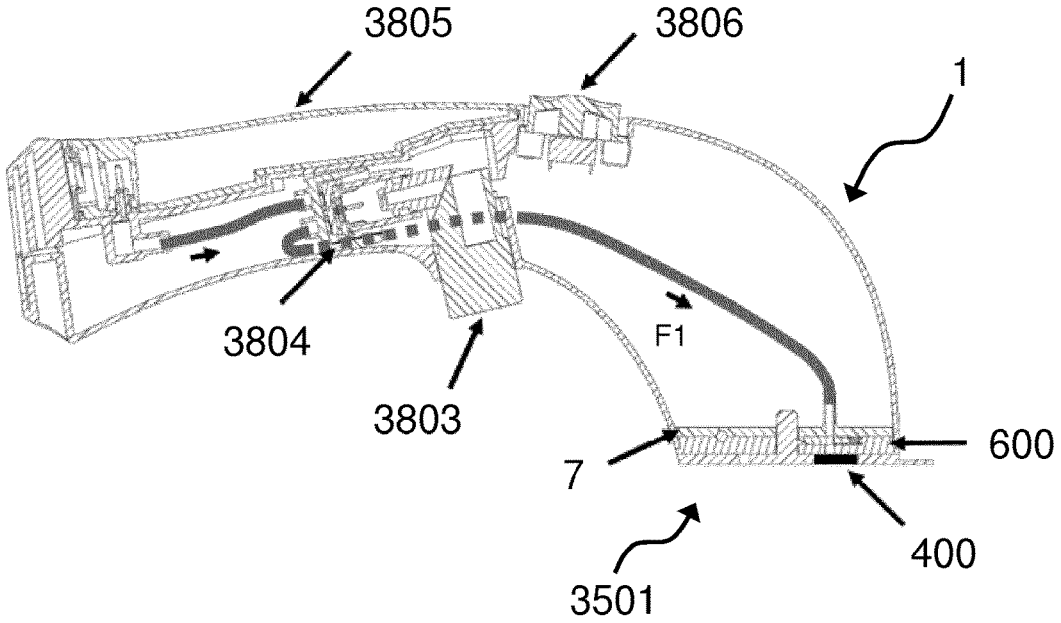
FIG. 16 depicts a stain removal accessory according to the invention when cooperating with a stain removal device 1 during the step of stain removing.

FIG. 16 depicts a stain removal accessory 3501 according to the invention when cooperating with a stain removal device 1 during the step of stain removing.

Figure 17:
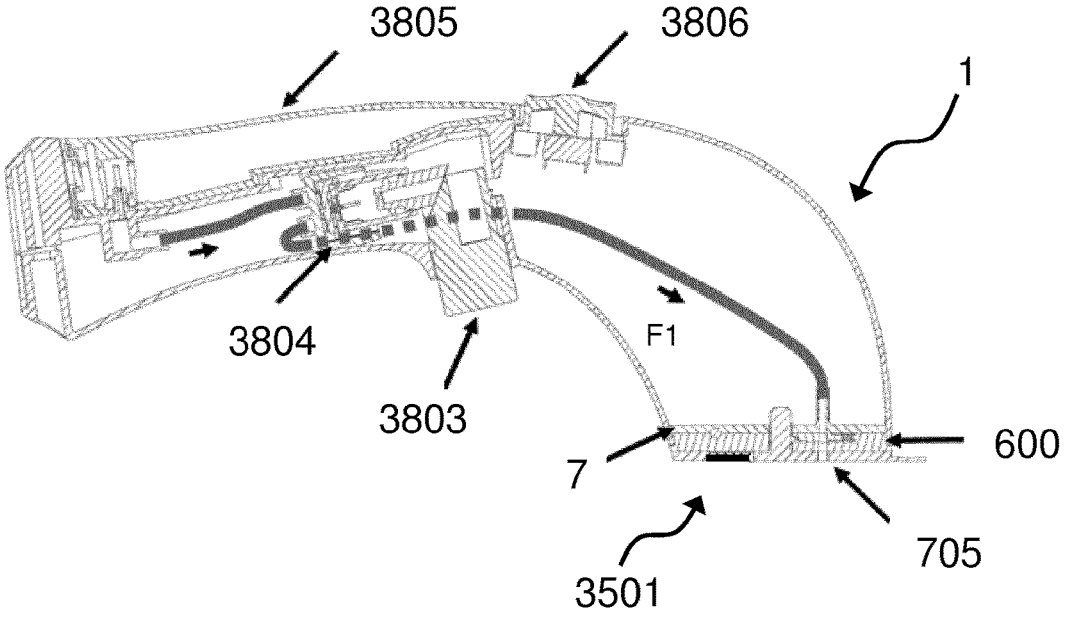
FIG. 17 depicts a stain removal accessory according to the invention when cooperating with a stain removal device during the step of rinsing (and drying)

FIG. 17 depicts a stain removal accessory 3501 according to the invention when cooperating with a stain removal device during the step of rinsing (and drying).

The stain removal device 1 comprises:

- a heating plate 7 adapted to diffuse heat to the holder 600 of the stain removal accessory 3501.
- a (refillable) tank 3805, for example detachable, for holding water used for both bleach chemical dissolution and stain rinsing,
- a fluid-dosing system 3804 (such as a pump) and the required tubes, for carrying water from the tank 3805,
- a fluid-dosing trigger 3803 to activate the fluid-dosing system 3804,
- a temperature switch 3806 (to switch the heating plate 7 from stain removal treatment temperature to drying temperature). Preferably, during the step of drying, the heating plate 7 should have a temperature between 60° C. and 170° C. Optionally, hot air of over 60° C. may also be used for drying.
- a water-flow switch 3601 as described above. The flow of fluid may be either bleach chemical solution (a solution of water and dissolved chemical) or rinsing water.
- Attaching means to attach the stain removal accessory 3501 (for example a locking stud).

Optionally, the stain removal device further comprises a liquid tank (not shown) for containing chemical neutralizer used during the step of rinsing.

Preferably, the chemical neutralizer is selected among any one of the following:

weak acid-like citric acid and/or sodium citrate;

weak alkaline-like sodium carbonate and/or sodium bicarbonate;

reducing agents.

Depending on the position of the stain removal accessory, the fluid flow path μl can be either a water-chemical hybrid flow path or a water flow path:

When the stain removal accessory is positioned in the step of stain removing, water flows from the water tank to the container 400 of the stain removal accessory, in order to dissolve the stain removal material and form a bleach chemical solution. This situation is illustrated in FIG. 16.

When the stain removal accessory is positioned in the step of rinsing the stained area, water flows from the water tank to the through hole 705 of the stain removal accessory. This situation is illustrated in FIG. 17.

An example of usage of a stain removal accessory according to the invention having only a one-time use container when cooperating with a stain removal device is as follows:

1. Insert central protrusion (physical element) of the stain removal accessory into the corresponding central hole provided in the front head of the stain removal device (as shown in FIG. 14). The physical element on the stain removal accessory slides into a groove and pushes the water-flow switch in the stain removal device to allow the water circuit be opened. Concurrently, the capacitive and/or resistive element 3504 comes in contact with the sensor in the stain removal device. The sensor then activates the conductive/inductive heater in the stain removal device, for example to heat the heating plate 7.
2. The stain removal accessory is turned 90 degrees (clockwise) to reach a position corresponding to the stain removing mode. In this position, the container 400 in the stain removal accessory is in the water pathway, i.e. aligned with the water outlet hole in the stain removal device. The user can thus press the pump trigger so that water flows through the container 400.
3. The holder 600 of the stain removal accessory is heated up by the heater in the stain removal device, for example by the heating plate 7, and allows heat transfer to the stained area.
4. The activation of water flow and heater in the stain removal device, the alignment of the container with the stain removal device water hole, and the transfer of heat to the stained area by the stain removal accessory allow the user to conduct the step of stain removing.
5. After stain removing treatment, the stain removal accessory is turned 180 degree anticlockwise to enter the rinsing/drying mode. In this position, the eccentric circular hole matches the water hole in the stain removal device, allowing water (without chemical) be applied on the treated stained area. It was observed that rinsing duration should be at least 10 seconds with this defined opening size and steam rate. The rinse duration should be at least 3 seconds for such a device 1 of the present invention. The rinsing fluid dosing rate can be between 5 g/min and 150 g/min.
6. In drying mode, a switch on the stain removal device is user activated to increase the heater power to heat the stain removal accessory to a higher temperature for a better drying effect. Optionally, the device enables two temperature settings, which is beneficial for treating different fabric types. For instance, delicate fabrics require lower temperature for drying, while normal fabrics can withstand higher temperatures for faster drying. Alternatively, drying may be achieved through other means of providing heat or air movement, such as hot air, radiation, moving air or vacuum extraction.
7. Finally, the stain removal accessory is turned back 90 degrees clockwise to the centre position to eject the stain removal accessory from the stain removal device.

The stain removal device 1 of the present invention for removing stains on fabrics is portable, and may have a power cord or be cordless.

To this end, power supply for the stain removal device can be connected to household supply while in operation (with power cord) or to an energy accumulator (cordless).

The energy accumulator can be a storage battery or a capacitor based storage (not shown). In this cordless type of implementation, the stain removal device 1 can be charged at home but used at other places like office, restaurant, etc. or can be brought out for traveling.

Figure 19:
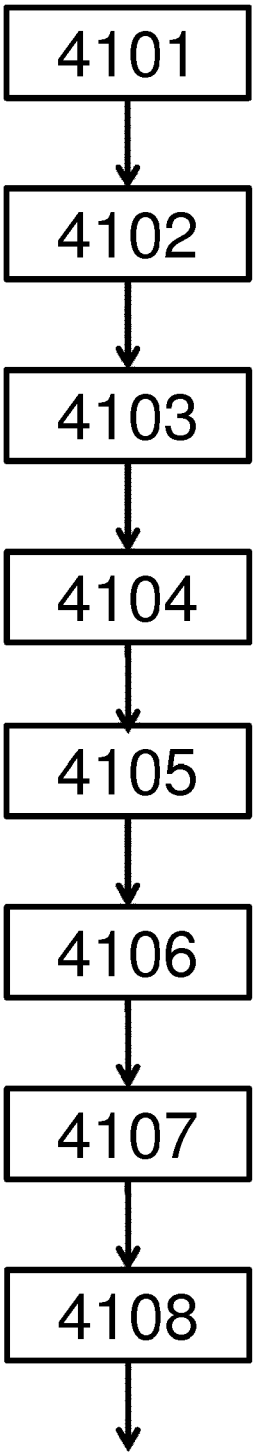
FIG. 19 depicts a flow chart of a method according to the invention of treating a stain on a garment.

FIG. 19 depicts a flow chart of a method according to the invention of treating a stain on a garment.

The method comprises the steps of:

coupling 4101 a stain removal accessory as previously described to a stain removal device 1 as previously described, dissolving 4102 with water the stain removing material in the container, applying 4103 the dissolved stain removing material over the stained area on the garment, heating 4104 the stained area for a certain duration.

Preferably, the method further comprises the steps of:

positioning 4105 the stain removal accessory to reach a rinsing position, dosing 4106 a certain amount of water over the stain for rinsing, heating 4107 the stain for drying.

In case the container of the stain removal accessory comprises a plurality of sub-compartments, the method further comprises a step of:

positioning 4108 the stain removal accessory to reach the position of a sub-compartment in which the stain removing material has not been used for stain treatment before, then the method continues from the step of dissolving 4102.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A stain removal accessory for use with a stain removal device for treating a stained area, the stain removal accessory comprising:

a container having a compartment surrounded by an external layer permeable to a fluid, wherein the compartment stores a stain removing material and is configured to receive the fluid from the stain removal device; and a flap-flip piece including a holder configured to hold the container and be pivotally attached to the stain removal device, wherein the flap-flip piece is configured to pivotally rotate to move the container between a first position in a stain removing mode and a second position in a rinsing mode, wherein, during the stain removing mode, the stain removal accessory is configured to release the stain removing material on the stained area as a result of flow of the fluid from the stain removal device, and to output the fluid and the stain removing material in a direction out from the stain removal accessory and towards the stained area, the fluid being different from the stain removing material, and wherein, during the rinsing mode, the stain removal accessory is configured to output the fluid without the stain removing material in a same direction as the direction out during the stain removing mode.

2. The stain removal accessory according to claim 1, wherein the holder comprises a frame structure arranged at least partly around the container.

3. The stain removal accessory according to claim 1, wherein the holder is configured to transfer heat from the stain removal device to the stained area.

4. A device comprising the stain removal accessory according to claim 1, the device including a water circuit and a water-flow switch to open/close the water circuit, and the stain removal accessory comprising a protrusion configured to activate the water-flow switch in the device in order to open/close the water circuit.

5. The stain removal accessory according to claim 1, wherein the stain removal device includes a sensor, and wherein the stain removal accessory further comprises a capacitor and/or a resistor for connection to the stain removal device.

6. The stain removal accessory according to claim 1, wherein the holder comprises a hand grip.

7. The stain removal accessory according to claim 1, wherein the stain removing material is a solid stain removing material and the container stores the solid stain removing material inside the compartment.

8. The stain removal accessory according to claim 1, wherein the fluid consists of water and/or steam.

9. A stain removal accessory for use with a stain removal device for treating a stained area, the stain removal accessory comprising:

a permeable container storing a stain removing material; and a holder configured to be coupled to the stain removal device, the holder having a surface with a first part and a second part being on a same plane, wherein the first part of the surface is configured to hold the permeable container, wherein the second part of the surface has a through hole for passing a fluid from a fluid pathway of the stain removal device to the stained area via the through hole, wherein the holder is rotatable between a first position in a stain removing mode and a second position in a rinsing mode where the stain removing material is moved away from the fluid pathway, wherein in the first position, the first part is fluidly coupled to the fluid pathway, and in the second position, the second part is fluidly coupled to the fluid pathway, and wherein the stain removal accessory is configured to release the stain removing material on the stained area as a result of flow of the fluid from the stain removal device to the stained area through the permeable container.

10. The stain removal accessory according to claim 9, wherein the holder is configured to transfer heat from the stain removal device to the stained area.

11. A device comprising the stain removal accessory according to claim 9, the device including a water circuit and a water-flow switch to open/close the water circuit, and the stain removal accessory comprising a protrusion configured to activate the water-flow switch in the device in order to open/close the water circuit.

12. The stain removal accessory according to claim 9, wherein the stain removal device includes a sensor, and wherein the stain removal accessory further comprises a capacitor and/or a resistor for connection to the sensor.

13. The stain removal accessory according to claim 9, wherein the permeable container comprises a plurality of sub-compartments, each sub-compartment of the plurality of sub-compartments comprising the stain removing material.

14. The stain removal accessory according to claim 9, wherein the holder comprises a hand grip.

15. The stain removal accessory according to claim 9, wherein in the second position, the second part is configured to pass the fluid from the stain removal device directly to the stained area via the through hole.

* * * * *